United States Patent [19]

Pongratz et al.

[11] Patent Number: 4,674,396

[45] Date of Patent: Jun. 23, 1987

[54] LOADING DEVICE FOR LARGE CALIBER WEAPONS

[75] Inventors: Leonhard Pongratz, Karlsfeld; Ulrich Degener, Schoengeising; Markus Spoetzl; Ferenc Kotai, both of Munich, all of Fed. Rep. of Germany

[73] Assignee: Krauss-Maffei A.G., Fed. Rep. of Germany

[21] Appl. No.: 864,278

[22] Filed: May 19, 1986

[30] Foreign Application Priority Data

May 17, 1985 [DE] Fed. Rep. of Germany ..... 3517750

[51] Int. Cl.[4] ..... F41F 9/06

[52] U.S. Cl. ..... 89/47

[58] Field of Search ..... 89/47

[56] References Cited

FOREIGN PATENT DOCUMENTS 2818279 11/1979 Fed. Rep. of Germany .

3326745 2/1985 Fed. Rep. of Germany .

*Primary Examiner*—Stephen C. Bentley

*Attorney, Agent, or Firm*—Robert J. Koch

[57] ABSTRACT

A loading device with a rammer, arranged for coupling with ammunition bases, exhibiting a transport and coupling segment. The coupling segment exhibits a plurality of grippers with claws adapted to engage an undercut base of ammunition. The bearing member for the grippers is movable with respect to the transport segment with a first limit position, corresponding to the maximum distance of the bearing member from the transport segment. The bearing member has a stop element for fixing the position of the bearing member relative to the ammunition base. After the rammer is moved against the base the transport segment is moved toward the coupling segment. The grippers are moved out of their rest positions assumed by the action of a resetting mechanism, and into their gripping positions against the edge of the base of the ammunition by an actuating member.

23 Claims, 12 Drawing Figures

FIG. 3
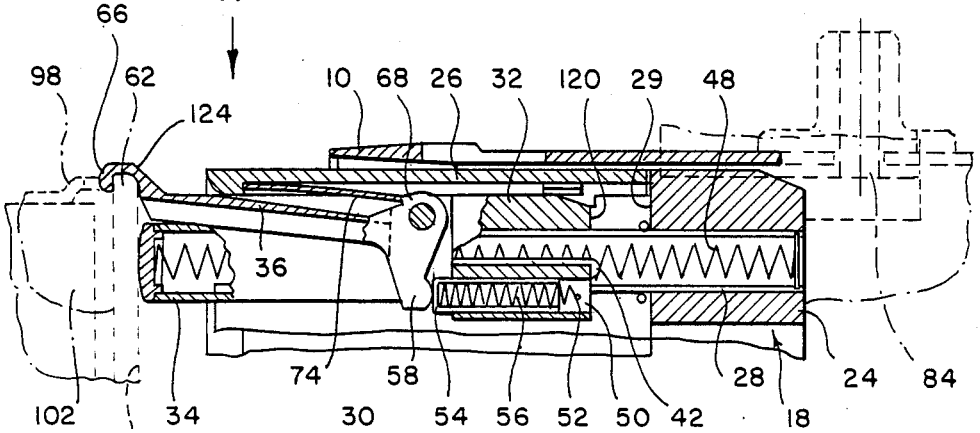
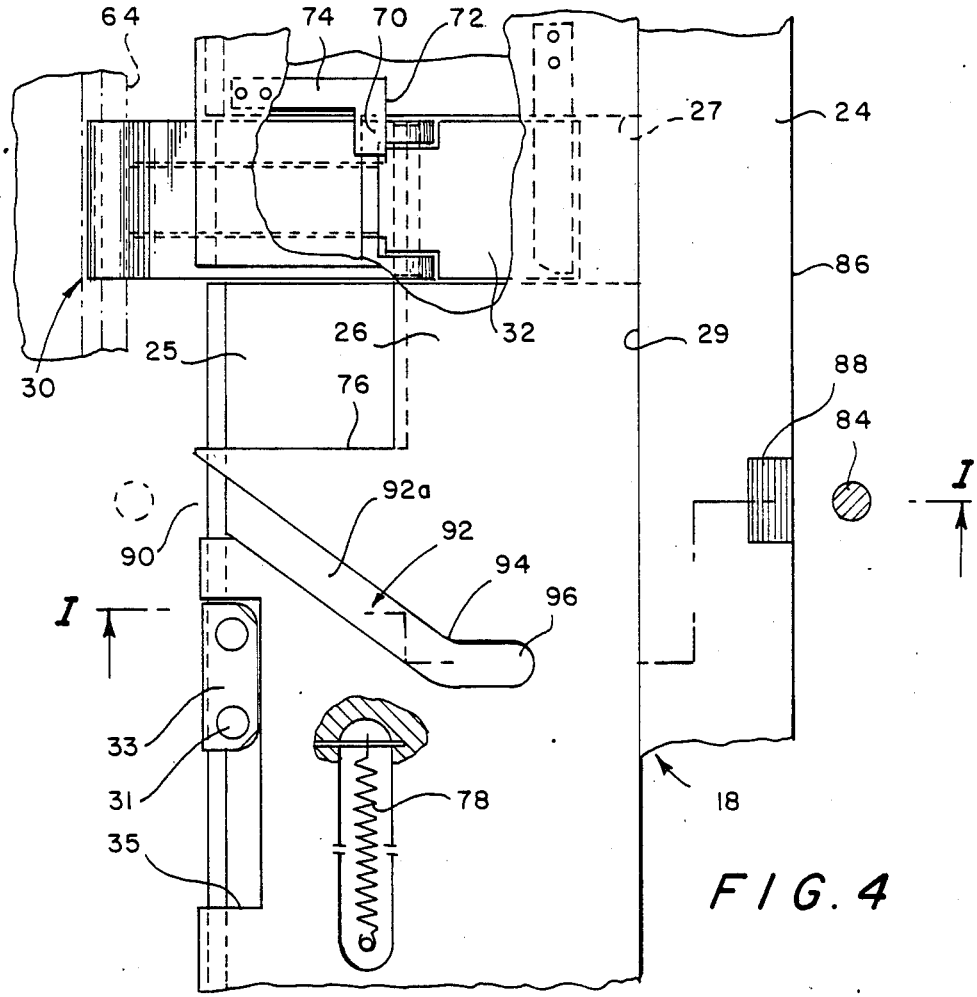
FIG. 4

FIG. 7
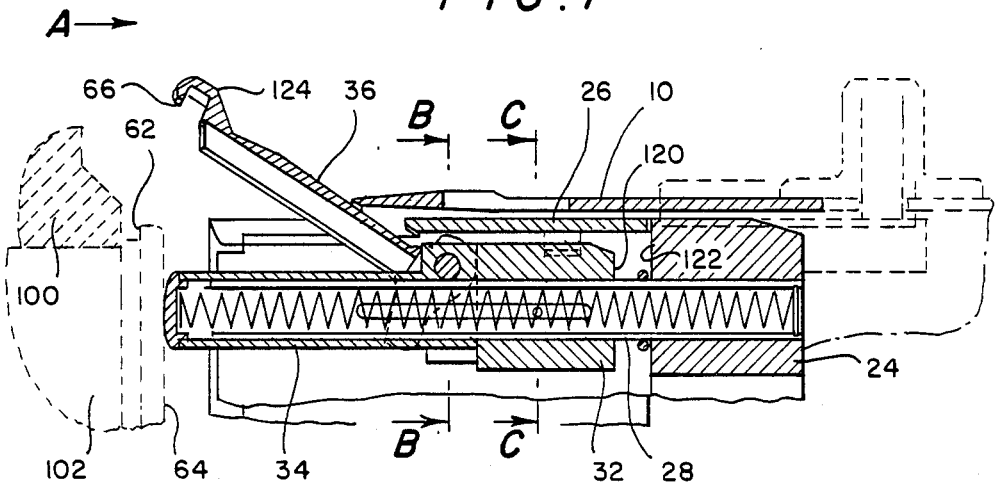
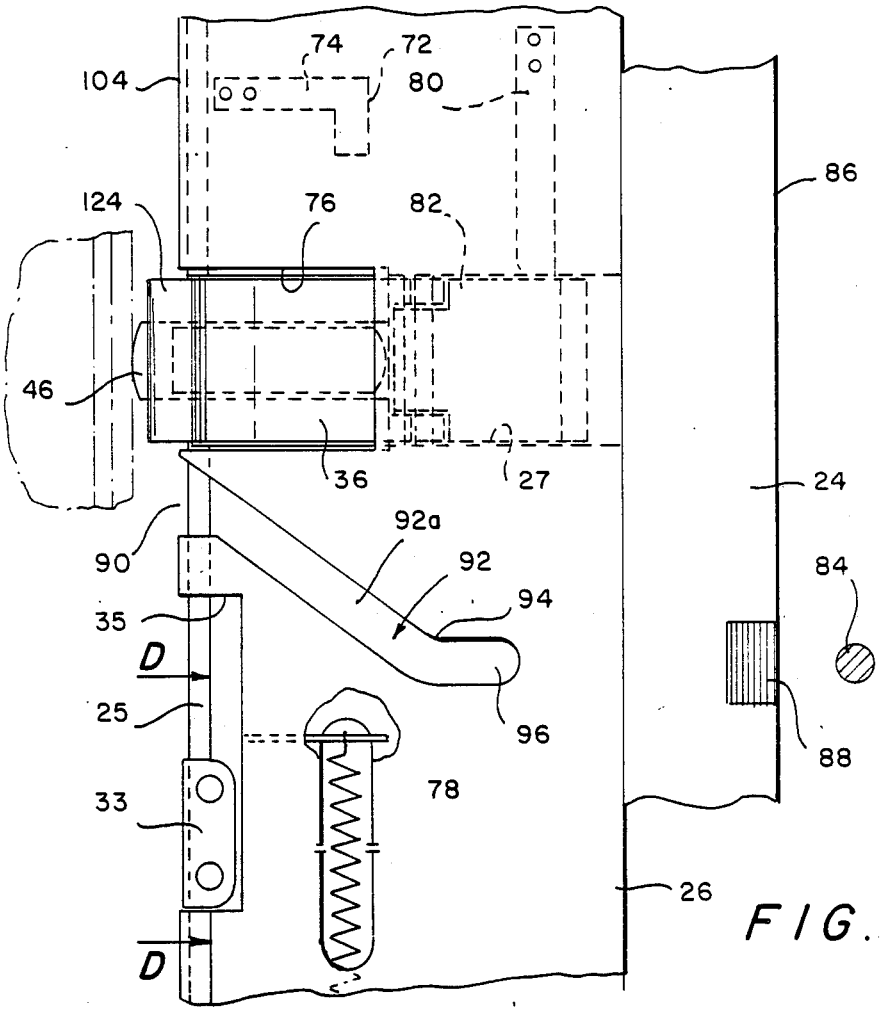
FIG. 8

LOADING DEVICE FOR LARGE CALIBER WEAPONS

BACKGROUND OF THE INVENTION

1. Field of the Invention

The invention relates to a device for loading large caliber weapons. More particularly a device including a rammer having a coupling suitable for connecting to the ammunication or cartridge base. The loading device is reciprocally movable with respect to a basic structural component such as a charging tube, in the loading direction. The component has a drive means for the rammer.

2. Description of the Related Art

Loading devices are known which are suited only for transferring the ammunition into a barrel, by transmitting a pushing force. When loading from a magazine, the magazine chambers or sleeves must have a slide-through cross section in order to accomodate such ammunition. Such systems have high engineering and economic draw backs because they have inflexible spatial configurations and the ammunition must be secured in position in a magazine chamber with a large slide-through cross section. In particular, there is the loss of unloadability, where unloadability is the possibility of returning, to the magazie ammunition which was previously transferred to the barrel.

Other known loading devices exhibit a rammer having a coupling suited to transmit, alternately, either a compression or tension force to the base of the ammunition, thus enabling one to dispense with slide-through magazine chambers and employ magazine chambers which match the cross section of the ammunition as it converges with progression toward the give or nose of the ammunition. The ammunition can be withdrawn from such a chamber in one axial direction and can be pushed back in the opposite axial direction. Thus, unloading the barrel to the magazine is also the possible. A problem of how to engage and release a grip-type coupling between the rammer and the base of the ammunication without losing systematic synchronization of such engaging and releasing with the reciprocal movement of the rammer exists with loading devices suited for sliding ammunition into a barrel or magazine chamber or the like, and for pulling ammunition out of the barrel or the magazine chamber.

The coupling must grip the ammunition when the rammer is pushed up against the base of the ammunition in order to withdraw the ammunition when disposed in the cartridge chamber or in the magazine chamber. After ammunition has been transferred into the cartridge or magazine chamber, the coupling must not grip but release the ammunition.

There are no control means shown for the coupling which can adapt to the different tasks.

Controllable electromagnetic couplings disposed on the rammer are known. For safety reasons it is extremely undesirable to employ electromagnetic fields in the vicinity of the base of the ammunition because of the danger of detonating the ammunition.

SUMMARY OF THE INVENTION

The invention addresses the problem of devising a loading device suited to transmit tension and compression forces to the ammunition base, without employing electrical or electromagnetic devices, suited to control the coupling and carrying out the above-described tasks. The loading or unloading process should be achievable as required, in fully automatic fashion, or order to free the operating personnel (gun crew) for other tasks, and to avoid the delays introduced by manual operation. An important factor in increasing fire rate is rapid loading. The rammer should be capable of actuating the coupling mechanism during the beginning or end phase of the unloading or loading movement relative to the basic structural components of the loading device so that there is no separate time interval required only for operation of the coupling mechanism.

When the weapon is mounted in a terrain vehicle, such as a tank, the loading device must be elastically mounted; therefore, despite a limited-play design, there will be uncontrolled shifting of the loading device with respect to the barrel and the magazine. The system must be able to ensure accurate coupling engagement even though the coupling mechanism is acutated while the rammer is in motion. It must be able to compensate for any position deviations between the rammer and the ammunition. The coupling mechanism must be able to center the ammunition with respect to the rammer in the event of any misalignment.

Spatial conditions are very tight in weapons with a wedge-type breech block necessitating an extremely compact loading device, which must meet requirements for free movement of parts, with adequate clearances for problem-free operation despite the tight space requirements.

The loading device must be configured such that elements which have high mobility for linearly moving the rammer are employed. For example, the rammer must be capable of being guided linearly in a charging tube and being moved linearly by a chain or member which is stiff in the face of reversal, i.e. rigid in compression and tension.

The loading device described above is configured such that the rammer comprises a transport segment connected to a drive means and a coupling segment. The rammer coupling region exhibits a circular cross section. The coupling region is directed away from or more distant from the transport segment, and directed toward or closer to the base of the ammunition. A plurlarity of grippers are distributed over the circumference of the coupling. The grippers are each movable radially between an outer, rest position triggered by at least one resetting mechanism, and an inner, gripping position. The grippers exhibit claws adapted to form-interlockingly engage the edge of the undercut base of the ammunition. The bearing members of the grippers are movable with respect to the transport segment between two limit positions. The movement is in the direction of the rammer movement into a first position, corresponding to the maximum mutual separation of the bearing members and the transport segment. Each bearing member is prestressed by a spring arrangement. Each bearing member for the grippers has a suitable stop element associated with it at a fixed distance, for lodging against the base of the ammunition. The transport segment exhibits an actuating organ which interacts with the grippers and is suited to move the grippers into their gripping positions when the second limit position is approached. The second limit position corresponds to the minimum mutual separation between the bearing members and the transport segment.

According to the invention coupling is actuated purely mechanically, by the movement of the transport segment. External control elements or auxiliary drive elements, particularly electric or electromagnetic motors are not required. The coupling segment moves against the base of the ammunition and accurately positions the bearing members of the grippers with respect to the base of the ammunition before the end of the movement of the rammer which brings the rammer close to the ammunition which is to be engaged. The gripping movement of the grippers is derived from further, continuing movement of the transport segment which necessarily brings the grippers into accurate engagement with the edge profile of the base of the ammunition. The base profile is matched by that of the grippers. The essentially radial movement of the grippers is suited to center the ammunition with respect to the rammer. the spring-loaded arrangement between the transport segment and the coupling segment is suited to compensate for deviations in the distance between the final position of the transport segment in the latter's approach to the base of the ammunition and the position of the ammunition.

The diameter required for the excursion space of the grippers need to be only slightly larger than that of the base of the ammunition due to the precise control of the grippers. The loading device is particularly suited for use with wedge-type breech block weapons.

In a very advantageous embodiment, each gripper is associated with a distinct bearing member having a respective stop element, and each such bearing member is movable independently of the other bearing members.

In an advantageous embodiment of the invention the transport segment has at least one positioning member which extends into the region of the grippers. The positioning member is movable between an active and an inactive position. In the active position the positioning member is sutied to move the grippers into their gripping positions when the transport segment and the bearing member(s) change from a first limit position to a second limit position. According to a further advantageous embodiment cooperating control organs are arranged in the basic structural component or charging tube and on the positioning member. The organs interact, when the rammer is moved from an end position which is distant from the coupling region, with the positioning member being initially disposed in the active position of said positioning member. The control organs are suited translate the relative movement of the basic structural component and the positioning member in order to move the positioning member into its inactive position. Locking organs are disposed on the coupling segment and on the positioning member. The organs interact in the second limit position of the bearing members and the transport segment after the positioning member is moved into its inactive position. The locking organs lock the positioning member in the inactive position. The organs disengage as soon as the bearing members and the transport segment are disposed in a position at least approaching their first limit.

When the rammer is moved toward the coupling region, if ammunition is present resistance provided by the ammunition results in the movement of the bearing members and the transport segment into their second limit position, in which they are a shorter distance apart. As long as the rammer is coupled to the ammunition, if no other means intervene to maintain the second limit position, the positioning member will be held in place by the locking organs after being moved into its inactive position during the pushing of the ammunition out of the loading device. The grippers move into their rest position and can release the ammunition toward the end of the movement of the rammer. If the loading device is empty, i.e., does not contain ammunition or a part thereof the bearing members and the transport segment remain in their first limit position. After the positioning member is moved into its inactive position it is not held in place by the locking organs, and will be returned to its active position. The grippers will be moved into gripping position toward the end of the movement of the rammer if the stop elements of the bearing members of the grippers encounter the base of a piece of ammunition.

According to a further advantageous embodiment at least one locking mechanism is disposed on the transport segment. The mechanism is arranged to assume a locking position whereby the grippers are held in their gripping positions as soon as the grippers are moved into the gripping positions by the positioning member. The locking mechanism is inactive when the positioning member is in the inactive position.

In this way the gripped ammunition is reliably transferred into the loading device. Provisions are provided to open the grippers when the positioning member is moved into its inactive position.

According to a further advantageous embodiment, a particularly simple and compact structure is achieved if the positioning member is a control bushing which surrounds the coupling segment, is disposed coaxially with the coupling region, and is rotatably mounted on a portion of the transport segment connected to the drive means. The control bushing exhibits recesses which permit the grippers to pass through when the control bushing is in its inactive position. The control organs are preferabley radially inwardly extending control rods which are spring-prestressed and mounted at a fixed location on the basic structural component of the loading device. A control groove is disposed on the outer surface of the control bushing surface facing the basic structural component. The axial length of the control groove is adjusted to the overall excursion of the rammer such that when the rammer is in its end position, direction away from the coupling region, a control rod is disposed ahead of the end of the control groove facing the coupling region. The end of the control groove is disposed at a circumferential angle to the control rod when the control bushing is disposed in its active position. As the rammer is moved toward its end position in the direction of the coupling region, the control rod leaves the axial region occupied by the control groove on the control bushing, namely it leaves said region before the rammer reaches the end position.

In a particularly advantageous refinement for handling ammunition with combustible casings, the transport segment is divided into two separate parts. The division is transverse to the direction of movement of the rammer. The two parts are connected by a catch arrangement suitable for transmitting tension forces in the direction of movement of the rammer. The part directed away from the coupling segment is connected to the drive means of the rammer. The catch arrangement is releasable by a tension force which exceeds a prescribed limiting value. This feature facilitates release of the two portions one from the other, in order to avoid damage if the ammunition becomes jammed.

Additional advantageous refinements will be evident from the dependent claims in combination with the description.

BRIEF DESCRIPTION OF THE DRAWINGS

The invention will now be described in more detail with reference to an exemplary embodiment illustrated in the drawings. This embodiment is in the form of a charging tube.

FIG. 3 is a longitudinal cross section through line E-G of FIG. 1, at a time after the gripper of the rammer has gripped the ammunition.

FIG. 4 is a partial breakaway view of a projection of a sector of the control bushing in the direction of arrow H of FIG. 3.

FIG. 7 is a cross section corresponding to FIG. 2, but at a time after the ammunition has been inserted in the breech and after release of the ammunition by the gripper of the rammer.

FIG. 8 is a view corresponding to the projection view of FIG. 4 for the situation of FIG. 7.

DETAILED DESCRIPTION OF THE PREFERRED EMBODIMENT

Figure 1:
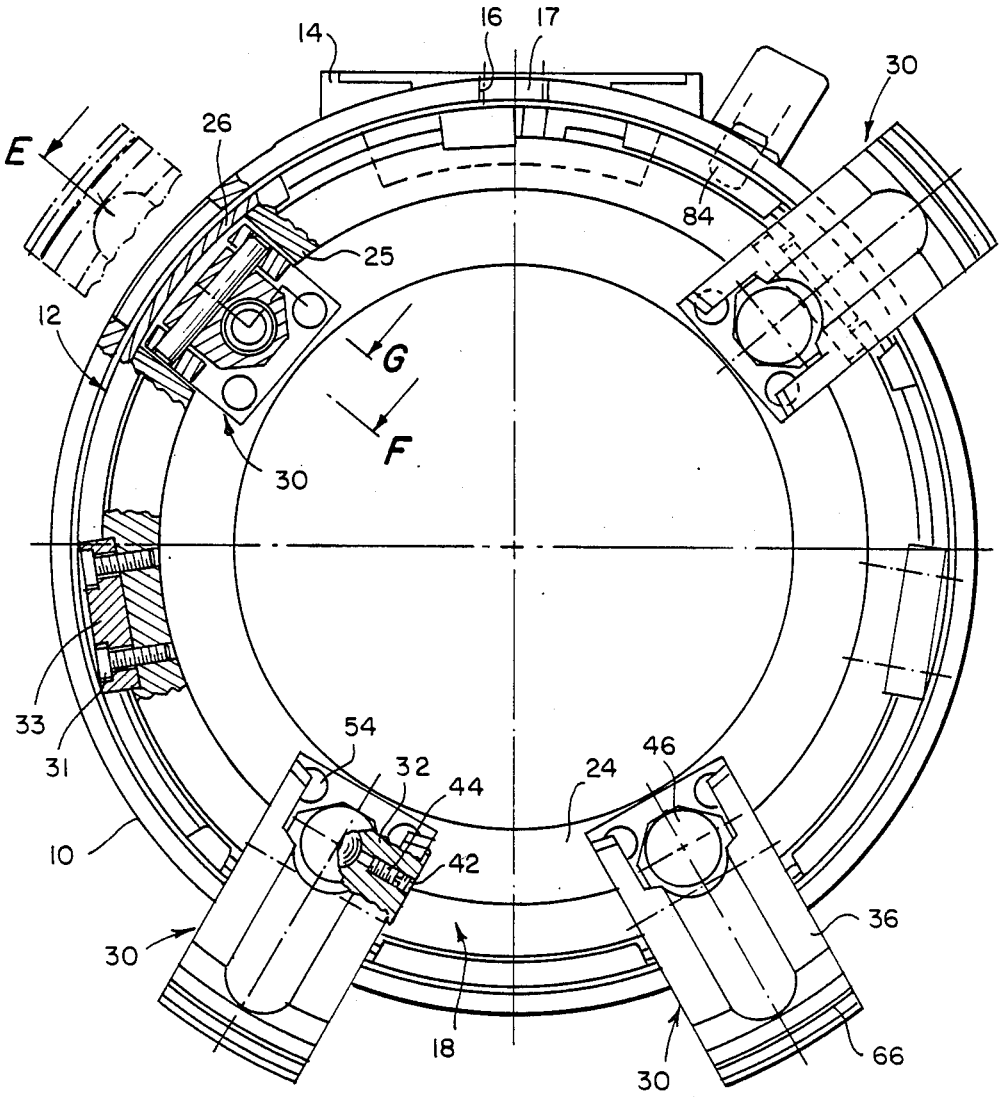
FIG. 1 is a view of the end of a charging tube according to the invention, at which tube the ammunition is admitted and removed, shown at a time following the release of the ammunition by the gripper of the rammer, with the aspect in the direction of arrow A of FIG. 7, and with partial cross sections (through lines B—B and C—C of FIG. 7, and D—D of FIG. 8).

In the illustrated embodiment the basic elements of the loading device comprises a charging tube 10 in which a rammer 12 is displacable between two end positions by a drive means (not shown). The drive means may be affixed to a console 14 (FIG. 1) on the outside of charging tube 10, and is connected to a transport segment 18 of the rammer 12 by a dog 17 which extends inward through a longitudinal slot 16 in the charging tube 10. The charging tube 10 is provided with an opening 20 on its left side as per FIG. 2, 3, 6, and 7, for receiving the ammunition from a magazine or weapon barrel. Alternatively the invention may advantageously employ a loading devices in which the ammunition is moved via the charging tube or a similar guiding mechanism on a path from the magazine into the breech; this is quite apparent from the description hereinbelow.

The rammer 12 is movable between an end position near the opening 20 (the gripping position) and a second end position distant therefrom. The ammunition picked up by the rammer and received into the charging tube 10 in the second end position. The axis of the charging tube 10 may be aligned with that of the weapon barrel or an ammunition chamber of the magazine. Deviations such as parallel shifts of axes or angular deviations can be compensated for and reliable functionng of the loading device can be ensured.

The rammer 12 comprises the abovementioned transport segment 18 and a coupling segment 22 disposed on the side of the transport segment 18 facing the opening 20. The transport segment 18 has a rammer ring 24 and a control bushing 26. The control bushing 26 is connected to the rammer ring 24 for common axial movement in the charging tube 10 and is rotatably mounted on a cylindrical part 25 of the rammer ring 24 facing opening 20. Transport segment 18 has four guide cylinders 28 which are distributed around the axis of the charging tube, disposed internally to the control bushing 26, and rigidly connected to the rammer ring 24. The guide cylinders are arranged in an axially parallel fashion in the region of recesses 27 which open toward the opening 20. The rammer ring 24 is connected to the dog configuration 17 of the drive means. The control bushing 26 rests against and is held in position axially by a shoulder 29 of the rammer ring 24. Detent blocks 33 are attached to the cylindrical part 25 by bolts 31. The blocks 33 engage recesses 35 which extend circumferentially and are open toward the opening 20. The recesses 35 serve to limit the rotationial movement of the control bushing.

The coupling segment 22 has four mutually independent basic sliding coupling members 30, each of which is disposed in a repective one of the recesses 27, and each of which has a traveling cylinder 34 rigidly connected to a sliding block 32. A gripper 36 is mounted on the sliding block 32 so as to be swingable around journal pins 38. The gripper is radially mobile around the axis of the loading device. The gripper 36 and traveling cylinder 34 extend towards opening 20 from the sliding block 32. A bore 40 runs through the sliding block 32. The bore is a continuation of the interior cavity of the traveling cylinder 34. The bore is engaged interiorly in an essentially zero-play engagement by a respective guide cylinder 2 so that each basic sliding coupling member 30 is movably guided, on the associated guide cylinder 28, relative to the transport segment and parallel to the axis of the charging tube. A rod 44 is engaged in a longitudinal slot in each guide cylinder and attached to the interior of the sliding block 32. The rod 44 extends radially into the bore 40. Longitudinal movement of the basic sliding coupling member 30 in the direction of the guide cylinder 28 is limited in this way. A cap 46 closes off the end of traveling cylinder 34 directed away from the sliding block 32. A helical compression spring 48 is disposed within of the traveling cylinder 34, the bore 40, and the guide cylinder 28, so as to push the basic sliding coupling member 30 into an extended position farthest from the transport segment 18.

Figure 6:
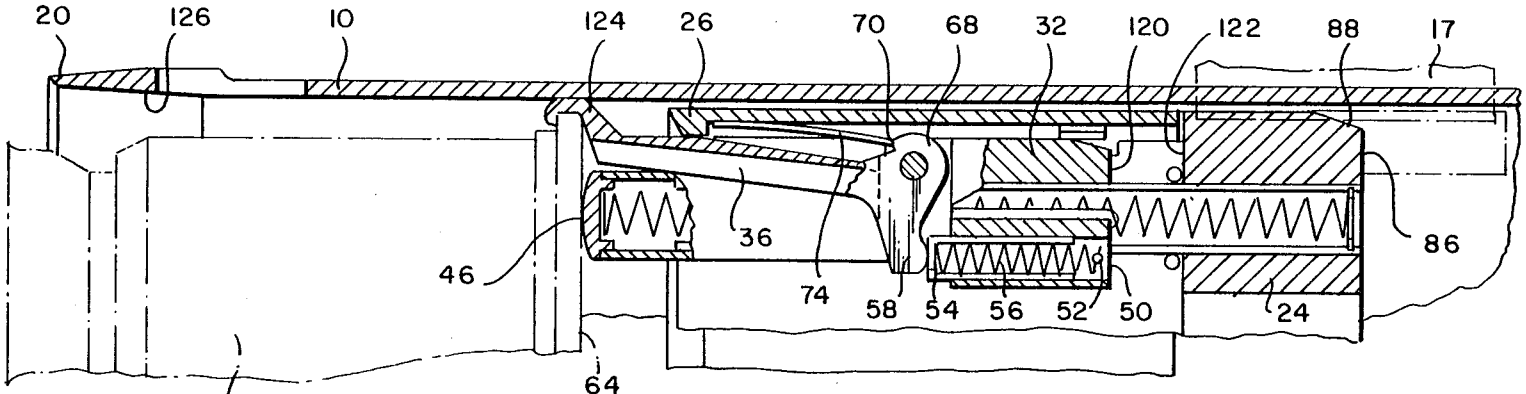
FIG. 6 is a cross section corresponding to FIG. 3, but with the rammer, which is holding the ammunition, in a position near its end position in which the ammunition is brought into the charging tube.
Figure 10:
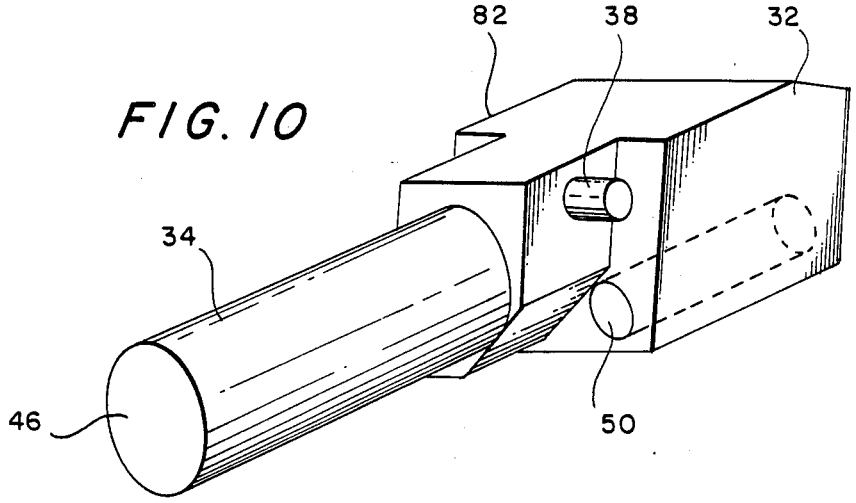
FIG. 10 is a perspective view of a sliding block with the traveling cylinder disposed thereon.
Figure 11:
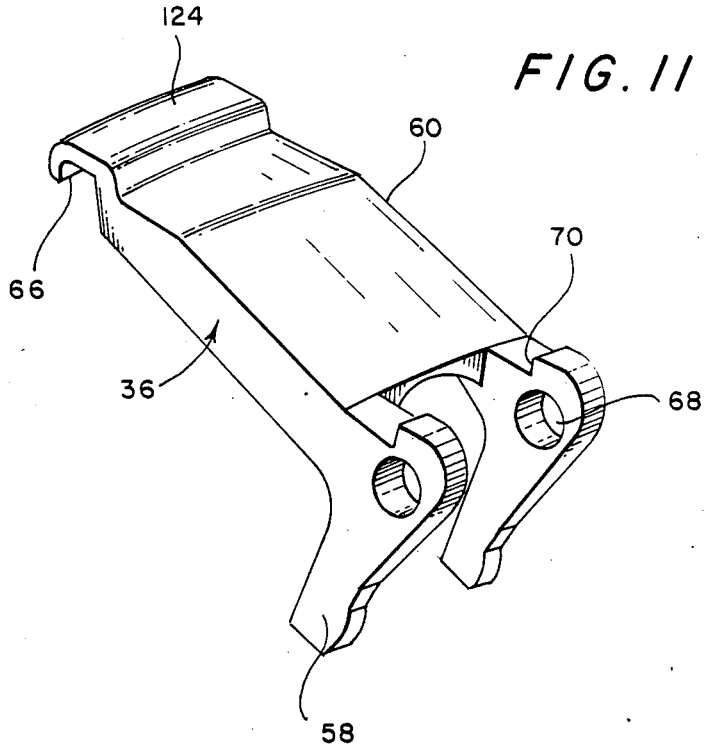
FIG. 11 is a perspective view of a gripper.

As is seen particularly clearly from FIGS. 3, 6, and 10, the sliding block 32 has at least one bore 50 parallel to the bore 40, with a compression spring 56 disposed in bore 50, one end of the spring 56 is braced against a pin 52 passing transversely through bore 50, and the other end of the spring 56 is braced against the closed end of a push cylinder 54 slidable disposed in bore 50. The spring 56 presses push cylinder 54 against a lever arm 58 integral to the gripper 36. The direction of the exerted force serves to pre-tension the gripper 36 in a radially outwardly lying rest position. As seen clearly from FIG. 11, the gripper 36 is in the form of a bent lever with the free end of the longer lever arm 60 exhibiting a gripping claw 66 which matches the curvature of the undercut edge 62 of the base 64 of the ammunition (FIGS. 3 and 6). The shorter lever arm 58 has two fork members where both parts of arm 58 can be associated with different respective bores 50, push cylinders 54, and compression springs 56.

The collar 68 on the hub region of the gripper 36 exhibits a detent shoulder 70 disposed approximately diametrically opposite the short lever arm 58 and directed toward the long lever arm 60. This shoulder extends approximately radially. It is suited to interact with the free end 72 of an enganging spring 74 such as a sheet spring attached to the control bushing 26 near the configured such that in the unstressed state its free end extends radially inward into the movement range of the detent shoulder 70.

The control bushing 26 exhibits open recesses 76 on facing opening 20, its end section facing opening 20. The open recesses 76 have a circumferential width which is approximately the same as that of the recesses 27 in the cylindrical part 26 of the rammer ring 24. The control bushing 26 is pre-tensioned in the base position shown particulary in FIG. 4), so that the detent blocks 33 rest against the edges of the recesses 35, in the counterclockwise direction (with reference to FIG. 1), so that the control bushing 26 can be rotated out of this position, through the counterclockwise angle defined by the recesses 35 by a tension spring 78. The tension spring 78 acts circumferentially one end of which engages the control bushing 26 while the other end engages the cylindrical part 25.

Figure 9:
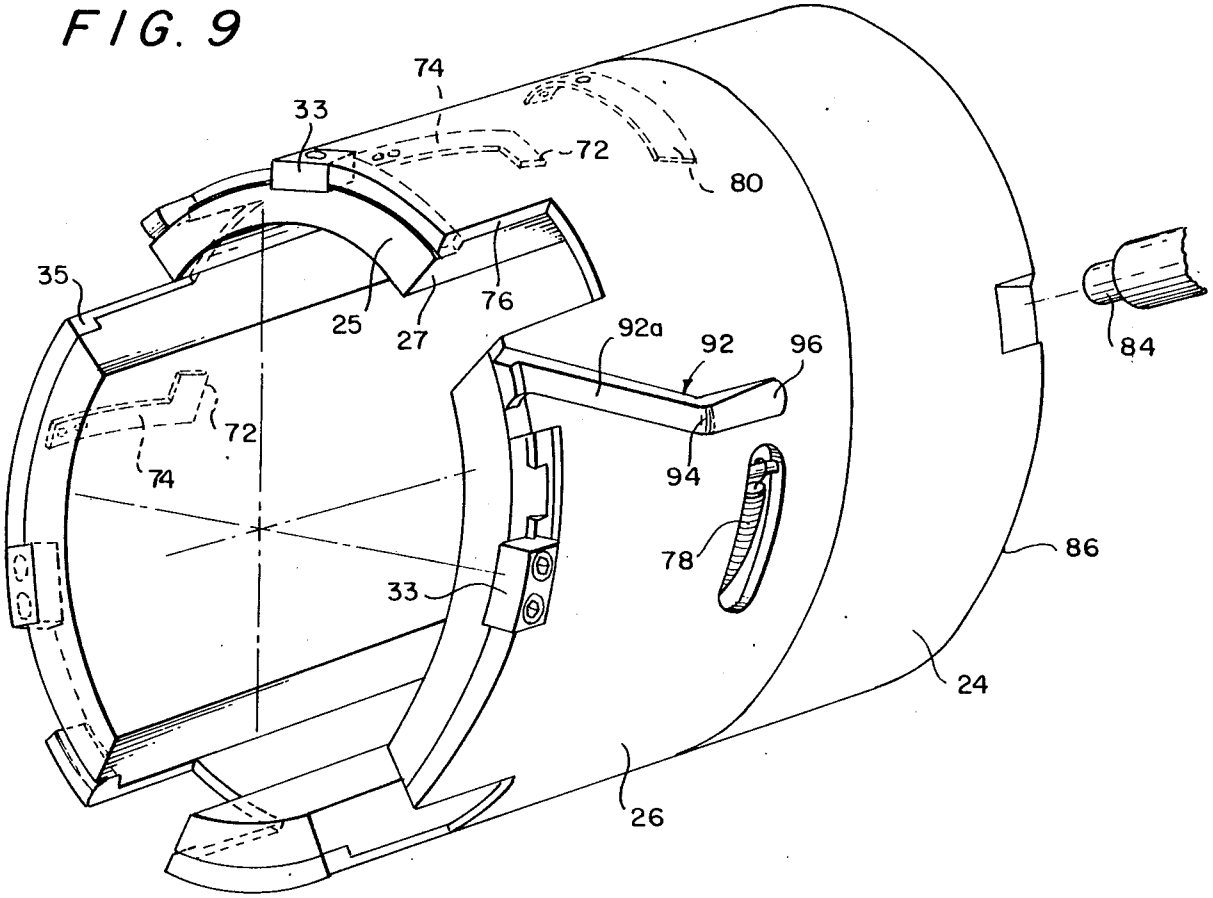
FIG. 9 is a simplified, perspective view of the control bushing corresponding to the situation of FIGS. 1, 7, and 8.

The tension spring 78 acts as a return spring and becomes more tensioned under rotation such that the recesses 76 align with the recesses 27 as shown in FIGS. 8 and 9. In this position the control bushing 26 does not prevent the long lever arms 60 of the grippers 36 from swinging radially outward into their respective rest positions under the action of the compression springs 56.

A sheet spring 80 is mounted on the inner wall of the control bushing 26. In the unstressed state its free end extends radially inward. This spring is suited for engaging the side face 82 of the sliding block 32 when in its excursion parallel to the axis of the loading device, is disposed in the range of said spring 80 (FIG. 8).

The engaging spring 74 has a L shape (FIG. 8) such that its bent-over free end 72 extends in the circumferential direction toward the opening 76. When the control bushing 26 is held in its base position by the return spring 78, the free end 72 extends into the region of the recess 27 and the path of the detent shoulder 70 disposed on the gripper 36. In the outer angular position of the control bushing 26, the engaging spring 74 is completely removed from the swinging range of the gripper 36.

Figure 5:
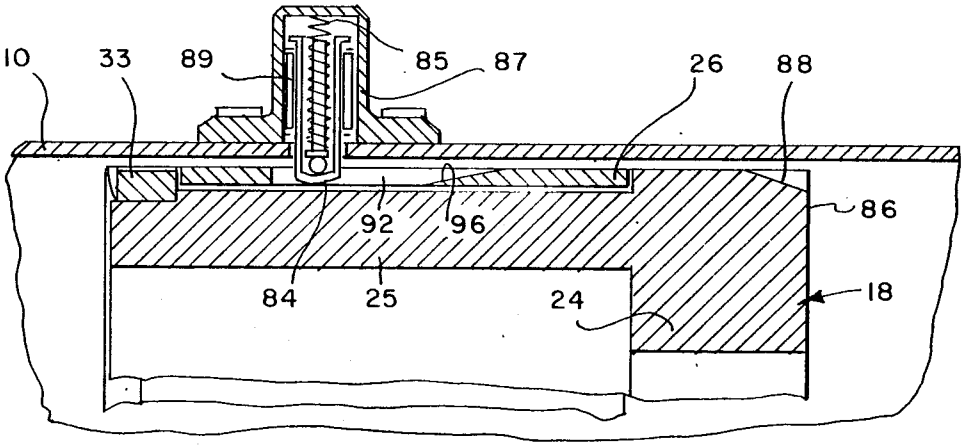
FIG. 5 is a cross section through line I—I of FIG. 4, passing through the charging tube and the control bushing.

A radially inwardly entending control rod 84 (FIG. 5) is fixedly mounted on the charging tube 10 and is spring-loaded by a radially inwardly acting spring 85 which is disposed in a guide bushing 87 for rod 84. The guide bushing 87 is mounted on charging tube 10. The control rod 84 is rotatably mounted in the guide bushing 87 with a needle bearing 89.

When the rammer 12 assumes its gripping position (FIG. 4), the tripping or control rod 84 is disposed behind the rear face 86 (directed away from opening 20) of the rammer 12. A raising ramp 88 is built into the rammer ring 24 at the rear side 86. The ramp is aligned with the control rod 84 i.e., the ramp is at the same angular position as rod 84 around the axis of the charging tube. When the rammer 12 is moved backward from its gripping position the ramp raises or deflects the control rod 84 to the outer surface of the rammer ring 24. The opening 90 of a control groove 92 is disposed on the edge of control bushing 26 facing opening 20 in angular alignment with the ramp 88. Groove 92 extends from opening 90 in a direction oblique to the axial direction of the control bushing 26, in the wall of said bushing, such that the inner end 94 of the oblique segment **92*a* of the control groove 92, viewed from opening 90, is at a position which is shifted clockwise with respect to opening 90. Adjoining inner end 94 is a raising ramp 96 suited for raising the control rod 84 out of the groove 92 and onto the outer surface of the control bushing 26**.

Figure 2:
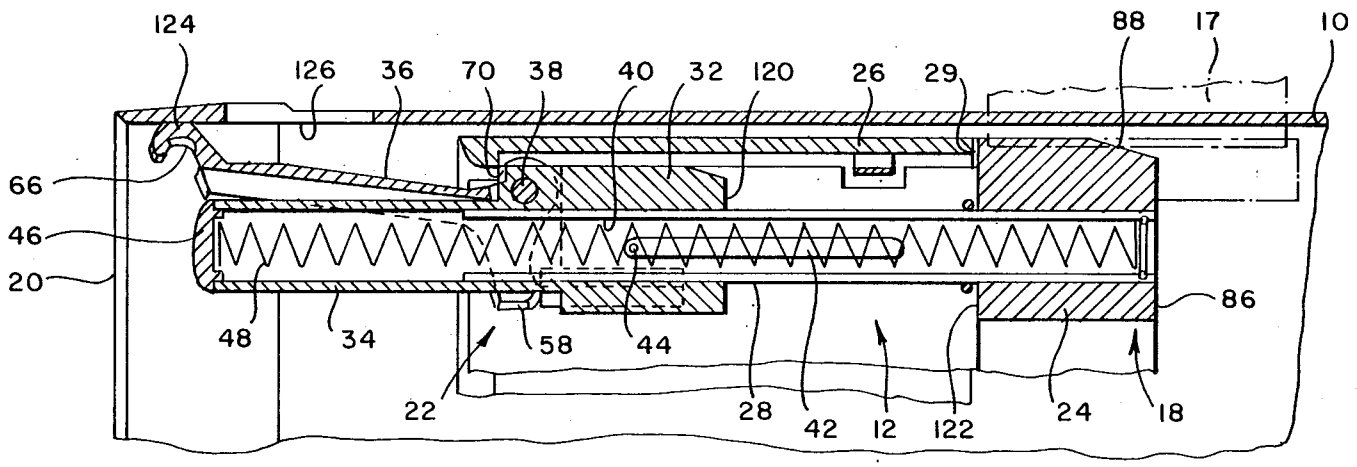
FIG. 2 is a longitudinal cross section through line E-F of FIG. 1, but with the rammer in rest position.

The operation of the system will now be described beginning with the rest position of the rammer 12 illustrated in FIG. 2. The rammer 12 automatically assumes its rest position. When actuated from the rest position, the rammer 12 first moves into its gripping position near the opening 20. Drive movement is transmitted to the transport segment 18 of the rammer 12 via the dog configuration 17. In the rest position, the sliding blocks 32 are pushed into an extended position farthest from the transport segment 18, by the helical compression springs 48. In this extended position, the sliding blocks 32 are still so far from the opening 20 in the other direction that the grippers 36 are [still] pushed radially inward into their gripping positions, by the charging tube 10, against the action of the spring 56. If now the transport segment 18 moves toward the opening 20, the coupling segment 22 encounters no initial resistance, so that distance between the transport segment 18 and the sliding blocks 32 is maintained. In the process, the grippers 36 move out of the zone of the charging tube 10 and spread mutually apart under the action of the compression springs (FIG. 7). In the process, the rammer 12 approaches the ammunition 102 disposed in a magazine 98 (FIG. 3) or in a weapon barrel 100 (FIG. 7). The gripper 36 move over the undercut edge 62 of the base 64 of the ammunition. The cap 46 of each traveling cylinder 34 strikes the ammunition base 64 precisely when the gripping claw 66 of the corresponding gripper 36 is disposed in the curved path through which the gripping claw 66 may be guided into interlocking engagement with the undercut edge 62 of the base 64 of the ammunition because of the distance between the end face of the cap 46 and the journal pins 38 of the grippers 36.

No problem results from slight misalignments (either angular or transverse) of the axis of the ammunition 102 with that of the charging tube 10 because each gripper 36 is movable with respect to the transport segment 18 via the guide cylinder 28 associated with the individual gripper. Such movement is independent of the other three grippers 36, and the traveling cylinders 34 and their respective grippers 36 and relatively close together in the radial direction. There is assurance under all conditions that the gripping claws 66 will accurately engage the undercut edge 62 of the base 64 of the ammunition as the transport segment 18 is moved further toward the opening 20. If the axis of the ammunition happens to be tilted with respect to that of the charging tube 10, the traveling cylinders 34 do not all simultaneously strike the base 64 of the ammunition, but rather they do so sequentially. The respective gripping claws 66 will be accurately positioned with respect to the undercut edge 62 in all cases.

Upon further motion of the transport segment 18 toward the opening 20, the coupling segment 22 no longer travels as it abuts the base 64 of the ammunition via the traveling cylinders 34. Accordingly, the helical compression springs 48 become compressed, and the control bushing 26 slides over the grippers 36, causing the grippers to swing radially inward and engage the base 64 of the ammunition over the undercut edge 62 (FIG. 3). In the process, the engaging spring 74 passes forward over the collar 68 of the gripper 36 and snaps in behind the detent shoulder 70 i.e., leftward of shoulder 70 in FIG. 3. When the rammer 12 is moved in the opposite direction (back out from the now-reached gripping position) into its rest position or farther on into the other end position, a coupling link is established between the transport segment 18 and the coupling segment 22.

To withdraw the ammunition 102 from the magazine 98 or barrel 100, the direction of movement of the rammer 12 is reversed. the transport segment 18 moves rightward (FIG. 3) along with the control bushing 26, out of the position shown in FIG. 3. The engaging spring 74 attached to the control bushing 26 transmits this movement to the gripper 36. The control bushing 26 prevents the gripper 36 from yielding to the force of the engaging spring 74, i.e. the gripper 36 is prevented from swinging outward. The movement is transmitted to the sliding block 32 from the gripper 36 by the journal pin 38, so that the transport segment 18 and the coupling segment 22 are moved together rightward, while the grippers 36 remain engaged with the ammunition 102, and the ammunition is also thereby pulled rightward.

During this rightward movement of the transport segment 18, the control rod 84 passes over the outer surface of the rammer ring 24 and then over the outer surface of the control bushing 26 as the rammer 12 is moved farther back into the charging tube 10 (seen in this backward progression in the intermediate position illustrated in FIG. 6), until finally the control rod 84 passes the forward edge 104 of the control bushing 102 and is pressed radially inward by the spring 85. The control rod at this point lies in the axial excursion path of the control bushing 26, namely ahead of the opening 90 of the control groove 92. When the rammer 12 reaches its rightward, fully retracted, position in the charging tube 10, the ammunition 102 is fully accomodated in the charging tube.

To deliver the ammunition 102 from the charging tube 10, the rammer must again be moved in a reversed direction, namely leftward (in FIG. 6). Upon such movement the control rod 84 passes into the control groove 92 and, in interaction with the oblique segment 92a of groove 92, causes the control bushing 26 to rotate in the counterclockwise direction (FIG. 1), thereby bringing the recesses 76 of the control bushing 26 into their positions in alignment with the recesses 27 in the cylindrical part 25 of the rammer ring 24 (FIG. 9). In this way the grippers 36 are released from the confining action of the control bushing 26, and can swing outward under the action of the compression springs 56, which swinging proceeds until they are blocked at their "fully open" position by the charging tube 10.

The described rotational excursion of the control bushing 26 moves the bent-over free ends 72 of the engaging springs 74 (as seen in FIG. 8) away from the region of the grippers 36, so that the transport segment 18 is no longer coupled to the coupling segment 22 in the direction opposite to the explusion movement being carried out. At the same time, the sheet spring 80 clicks into place behind (i.e., in the counterclockwise direction with respect to) the side surface 82 of the sliding block 32, thereby preventing further retraction of the control bushing 26 by the tension spring 78 which is tensioned by the rotational excursion of the control bushing 26 which is occurring. This, the control bushing 26 becomes blocked in the angular position which enables the grippers 36 to move open, and the grippers 36 fully open when they leave the region of the charging tube. The ammunition 102 is pushed completely into the barrel 100 (FIG. 7) or the magazine 98, by the traveling cylinder 34, and the coupling condition with the coupling segment 22 is i.e., has been released. During this process the control rod 84 is lifted back to the outer surface of the control bushing 26 via the raising ramp 96 and finally passes over the rear side of the rammer 12 where it is pressed radially inward again by the spring 85.

If the direction of movement of the rammer 12 is changed once again (i.e., to rightward movement), at first only the transport segment 18 moves rightward from the position shown in FIG. 7, because the engaging spring 74 is no longer in engagement with the coupling segment 22. The interiorly directed rod 44 connected to the sliding block 32 moves in the longitudinal slot 42 to the left end thereof, and is then carried along by the guide cylinder 28, so that the coupling segment 22 shares the movement of the transport segment 18 as soon as the two segments reach their maximum axial distance apart, as seen in FIG. 2. In the process the sliding block 32 leaves the axial region of the sheet spring 80, so that the control bushing 26 is no longer held against sheet spring 80 and the tension spring 78 can move the control bushing 26 back into the position of said bushing corresponding to the rest position (FIG. 4). Also, the grippers 36 have been swung back into the interior space of the control bushing 26, by means of the recesses 76, so as not to hinder the repositioning of the control bushing 26. To facilitate this, the ends of the grippers 36 bearing the claws 66 have been provided with a radially exterior sides which can slide along the interior surface 126 of the charging tube 10 and cause the grippers to swing radially inward. The end of the gripper 36 provided with the camshaped prominence 124 is disposed ahead of the forward edge 104 of the control bushing 26 (the forward edge facing away from the transport segment 18) so that the prominence 124 cannot hinder rotation of the control bushing 26. As soon as the rammer 12 reaches the rest position (FIG. 2), the axial movement of the rammer 12 ends in the present example.

If the rammer 12 is again moved toward the magazine 98 or the barrel 100, the gripping mechanism is not actuated until the traveling cylinder 34 strikes the base 64 of the ammunition.

Figure 12:
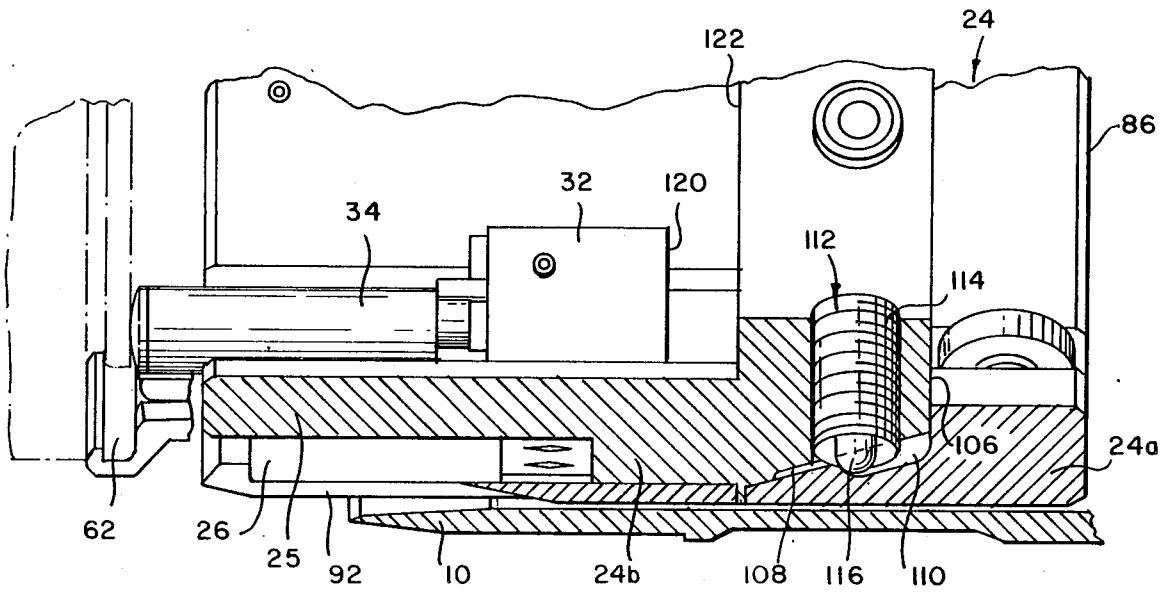
FIG. 12 is a schematic cross sectional view through the end of the rammer directed away from the coupling segment, in an alternative embodiment.

FIG. 12 illustrates an advantageous alternative embodiment. The rammer ring 24, is divided into two parts; namely, an end segment 24*a* bearing the dog configuration 17, and another segment 24*b* comprising the cylindrical part 25 and bearing the control bushing 26. The joint surfaces separating the two segments 24*a* and 24*b* comprise an inner joint part 106 which extends normal to the axis of the rammer, and a conically diverging outer joint part 108 which adjoins inner part 106, with the conic divergence being toward segment 24*b*. A ring-shaped groove 110 is provided in end segment 24*a*, in the outer joint part 108 at a location immediately adjacent the inner joint 106. A plurality of spring-loaded catch elements 112 are provided in segment 24*b*, distributed around the circumference of segment 24*b* and disposed facing and radially inward of ring-shaped groove 110. Each such catch element comprises an outwardly directed compression-spring-loaded catch sphere 116 disposed in a housing 114 with exterior adjustment threads. The catch sphere can be pushed back into the housing 114 by a force exerted against the spring force. Catch sphere arrangements are known, and will not be described in more detail here. The configuration is such that the catch spheres 116 engage the ring-shaped groove 110. In accordance with the spring force which is set, up to a limiting value of the spring force depending on such setting, the tension force from the dog configuration 17, which force is exerted on the inner joint part 106 i.e., the end segment 24*a*, in the convergence direction of the conical segment 108, is transmitted to the segment 24*b* of the rammer ring 24. The maximum transmittable tension force is adjusted to remain less than the force which could cause failure of the casing or separation of the lateral part of the casing from the base of the ammunition, when ammunition with a combustible or expendable casing is used. This avoids a situation where unforseen problems causing the ammunition to resist the tension force exerted by the rammer engaging the base 64 of the ammunition might result in damage to the ammunition.

If the ammunition 102 in the magazine 98 or the barrel 100 is shifted radially, it will nonetheless be securely gripped in the manner described supra, as a result of the independent functioning of the grippers 36. Then, by the action of the control bushing 26 rotationally mounted coaxially with the rammer axis, the ammunition 102 will be centered on the grippers 36 before the rammer 12 pulls it out of the magazine 98 or barrel 100.

As may be seen clearly from FIG. 3, after the ammunition 102 is gripped by the grippers 36, the gripping claws 66 are disposed at a distance ahead of the forward edge 104 of the control bushing 20, in this position, this distance corresponds approximately to the distance between the mutually facing end faces 120 and 122 of the set of sliding blocks 32 and the rammer ring 24, respectively. This facilitates not only the absorption of manufacturing deviations but also compensation for relatively large uncontrolled axial movements of the basic structural component, here the charging tube 10. Such movements might be caused by elastic mounting of the said basic component in a terrain vehicle with loading of the ammunition being carried out while under way.

We claim:

1. A loading device for large caliber weapons comprising:

a charging tube;

a rammer reciprocally movable between a retracted and an extended position relative to and arranged coaxially with said charging tube and including a transport segment;

means for driving said rammer associated with said transport segment;

means for coupling said rammer with a base portion of ammunition associated with said rammer including a plurality of means for gripping said ammunition base portion circumferentially distributed on said rammer, said means for gripping is radially displaceable between an inner gripping position and an outer resting position;

means for resetting said means for gripping to said outer resting position associated with each means for gripping;

means for bearing said means for gripping axially displaceable relative to said transport segment between, a prestressed, extended position and a compressed position;

means for actuating said means for gripping into said inner gripping position including a stop element associated with said means for bearing which upon contact with said ammunition base in said extended position of said means for bearing initiates actuation of said means for gripping and causes said means for actuation to radially displace said means for gripping to said inner gripping position upon said means for bearing attaining said compressed position relative to said transport segment.

2. A loading device according to claim 1 wherein each means for gripping is independently associated with a distinct means for resetting, means for bearing, and a respective stop element;

wherein each means bearing for is displaceable independently of other means for bearing with respect to said transport segment.

3. A loading device according to claim 2, wherein said means for bearing is displaced along an axis parallel to an axis of displacement of said transport segment.

4. A loading device according to claim 3, wherein said means for actuating further comprises:

a control means associated with said transport segment, and moveable between an active position for radially displacing said means for gripping and an inactive position for releasing said means for gripping; and means for prestressing said control means into said active position.

5. A loading device according to claim 4, wherein said charging tube exhibits a first control element and said control means exhibits a second control element;

said first and second control elements are arranged to cooperate, upon advancement of said rammer from said retracted position to said extended position when said means for gripping are engaging an ammunition base, to displace said control means from said active position to said inactive position as a function of relative motion of said charging tube and said transport segment;

and further comprising means for locking said control means in said inactive position and releasing said control means when said means for bearing approach there extended position, disposed on said control means.

6. A loading device according to claim 5, further comprising:

second means for locking said means for gripping in said inner gripping position and releasing said means for gripping when said control means is in said inactive position, disposed on said control means.

7. A loading device according to claim 6, wherein said control means is a control bushing which surrounds and is coaxial with said means for coupling, said control bushing is rotatably mounted on said transport segment;

said control bushing exhibits recesses arranged to release said means for gripping when said control bushing is in said inactive position.

8. A loading device according to claim 7, wherein said first control element is a radially inwardly extending spring loaded control rod fixedly mounted on said charging tube;

said second control element is a control groove in an outer surface of said control bushing facing said charging tube; wherein the control groove exhibits an axial length which corresponds to axial displacement of said rammer such that when the rammer is in said retracted position the control rod is disposed ahead of a leading end of said control groove, said leading end of the control groove is disposed at an angle to the control rod when the control bushing is said active position, and said control groove is further configured so as when said rammer is displaced toward said extended position said control rod leaves an axial region occupied by the control groove.

9. A loading device according to claim 8, wherein said control leading edge of said groove opens on an end face of said control bushing directed toward said ammunition.

10. A loading device according to claim 9, wherein said control groove exhibits a transition ramp for raising said control rod to said outer surface of the control bushing at a trailing end of said control groove.

11. A loading device according to claim 10, wherein said transport segment exhibits a ramp disposed on a rearward edge for cooperating with said control rod;

said control rod is arranged on said charging tube, aligned with and rearward of said ramp when said transport segment is in said extended position.

12. A loading device according to claim 11 further comprising means for limiting rotational motion of said control bushing to rotation between said active and inactive positions disposed on said transport segment and said control bushing.

13. A loading device as in claim 12, wherein said second means for locking is prestressed in a locking position and is further arranged to relationally lock said means for bearing and said transport segment upon extension of said transport segment and actuation of said means for gripping; and wherein said first and second control elements are arranged to release said second means for locking upon subsequent extension of said transport segment toward said extended position.

14. A loading device according to claim 13, wherein said second means for locking comprises a locking pawl aligned with a detent disposed on said means for gripping so that said locking pawl engages said detent when said means for gripping is in said inner gripping position.

15. A loading device according to claim 14, wherein said locking pawl is arranged to brace against said detent in a locking position and thereby exerting a rearward bracing force.

16. A loading device according to claim 15, wherein said locking pawl is disposed outside of a motion path of said detent when said control bushing is in said inactive position.

17. A loading device according to claim 16, wherein said locking pawl sheet spring.

18. A loading device according to claim 13, wherein when said means for bearing are in said extended position said means for gripping extend beyond said control bushing in a direction of said extension; and said means for gripping exhibit a radially outwardly directed prominences which cooperates with a sliding surface of said charging tube when said means for gripping are disposed within said charging tube against a force exerted by said means for resetting so as to maintain said means for gripping in said inner gripping position and so as to allow rotation of said control bushing to said active position.

19. A loading device according to claim 18, wherein said charging tube is cylindrical, and said sliding surface is an interior wall of said charging tube.

20. A loading device according to claim 13, wherein said transport segment comprises a first part connected to said means for driving and a second part connected to said means for coupling; and connection means for releasing a connection between said first and second parts upon exertion of a predetermined tensil force by said means for driving.

21. A loading device according to claim 20, wherein said predetermined tensil force is adjustable.

22. A loading device according to claim 1, wherein said transport segment comprises a first part connected to said means for driving and a second part connected to said means for coupling; and connection means for releasing a connection between said first and second parts upon exertion of a predetermined tensil force by said means for driving.

23. A loading device according to claim 22, wherein said predetermined tensil force is adjustable.

* * * * *